US008029108B2

(12) United States Patent
Takeuchi

(10) Patent No.: US 8,029,108 B2
(45) Date of Patent: Oct. 4, 2011

(54) LIQUID JETTING HEAD AND LIQUID JETTING APPARATUS

(75) Inventor: Yoshio Takeuchi, Hachioji (JP)

(73) Assignee: Konica Minolta Holdings, Inc. (JP)

( * ) Notice: Subject to any disclaimer, the term of this patent is extended or adjusted under 35 U.S.C. 154(b) by 622 days.

(21) Appl. No.: 11/699,178

(22) Filed: Jan. 29, 2007

(65) Prior Publication Data

US 2007/0176985 A1 Aug. 2, 2007

(30) Foreign Application Priority Data

Feb. 2, 2006 (JP) ..... 2006-025538

(51) Int. Cl.
*B41J 2/045* (2006.01)

(52) U.S. Cl. ..... 347/68

(58) Field of Classification Search ..... 347/68, 347/69, 70, 71, 72

See application file for complete search history.

(56) References Cited

U.S. PATENT DOCUMENTS 7,367,658 B2 * 5/2008 Kusunoki et al. ..... 347/68

FOREIGN PATENT DOCUMENTS

JP 2001-162795 6/2001

* cited by examiner

*Primary Examiner* — K. Feggins

(74) *Attorney, Agent, or Firm* — Cantor Colburn LLP

(57) ABSTRACT

A liquid droplet jetting head, having: a plurality of dividing walls to divide a plurality of flow channels, wherein at least a portion of the dividing wall is formed with a piezoelectric element; a flow path having a rectangular tubular from formed by an upper wall to close an upper surface of the flow path along an array direction of the plurality of the flow paths, and a lower wall to close a lower surface of the flow path; a nozzle to jet liquid in the flow path as the liquid droplet; and two driving electrodes formed independently on each wall surface of the dividing wall in a longitudinal direction of the flow path having the rectangular tubular form, wherein the nozzle is formed on either the upper wall or the lower wall.

12 Claims, 9 Drawing Sheets

LIQUID JETTING HEAD AND LIQUID JETTING APPARATUS

This application is based on Japanese Patent Application No. 2006-025538 filed on Feb. 2, 2006, in Japanese Patent Office, the entire content of which is hereby incorporated by reference.

BACKGROUND OF THE INVENTION

The present invention relates to a liquid droplet jetting head to jet liquid from a nozzle and a liquid droplet jetting apparatus.

In a liquid jetting head to jet a liquid droplet from a nozzle such as an inkjet head (hereafter may called just head) to record an image by using a minimal ink droplet, a pressure generating device applies a pressure to a pressure generating chamber to jet the ink droplet from the nozzle so as to land the ink droplet on a recording medium like a recording sheet.

Conventionally, so called shear mode type ink jet recording head (hereinafter also called shearing mode head) has been known in which an actuator substrate is configured by forming a number of channels on a polarized piezoelectric element, a cover plate is bonded on an upper surface of the actuator substrate so as to form a number of pressure generating chambers separated by the aforesaid piezoelectric element, an electric field is applied to the piezoelectric element between the adjacent pressure generating chambers so as to deform the piezoelectric element and to jet ink from a nozzle hole formed on the cover plate or a bottom surface of the actuator substrate (Patent document 1).

Patent document 1: Japanese Patent Non-Examined Publication No. 2001-162795

In recent years, highly-functional and high quality inkjet printers are being demanded which are capable of multi step tone reproduction and resolution change, for example 300 dpi and 600 dpi to realize a high-resolution print image.

In a head disclosed in the Patent document 1, ink is jetted from the nozzle by driving the piezoelectric elements of the pressure chambers which are provided for each of nozzles one-on-one. Thus as a method to change an amount of ink droplet, it is considered that an injection amount of ink droplet is changed in accordance with driving condition such as a voltage value of a driving pulse applied to the piezoelectric element. However, usually, it was difficult to change the driving condition to a large degree so as to change a diameter of the ink droplet. In particular, it was not possible to control the amount of ink droplet without changing a speed of the ink droplet.

Further, as the other method, it is also considered that the ink droplets are shot redundantly a plurality of times for one dot by using a nozzle to jet small ink droplets and the number of shots is controlled for contrast control. In this method, a variable contrast image can be outputted consistently in a sufficiently high quality though, a decrease of a printing speed is caused since the ink jetting is carried out the plurality of times.

Also, as yet another method, it is considered that a plurality of nozzles having different ink jetting amount are disposed and combined selectively to reproduce contrast. In this case, though a level of contrast increase, there is a problem that a cost of manufacturing the head increases as the recording head becomes large.

SUMMARY

The invention has been achieved in view of the above problems, and an object of the present invention is to provide a liquid droplet jetting head and liquid droplet jetting apparatus where manufacturing is easy, the manufacturing cost can be reduced, and an amount of ink droplet can be varied in a multi-step without causing side effects such as a fluctuation of a flying speed of the ink droplet.

The above object can be achieved by each of the following structures of the present invention.

(1) A liquid droplet jetting head, having: a plurality of dividing walls to divide a plurality of flow channels, wherein at least a portion of the dividing wall is formed with a piezoelectric element; a flow path having a rectangular tubular form formed by an upper wall to close an upper surface of the flow path and a lower wall to close a lower surface of the flow path, along an array direction of the plurality of the flow paths; a nozzle to jet liquid in the flow path as a liquid droplet; and two driving electrodes independently formed on each wall surface of the dividing wall in a longitudinal direction of the flow path having the rectangular tubular form; wherein the nozzle is formed on either the upper wall or the lower wall.

(2) The liquid droplet jetting head of (1), wherein driving signals are applied to each of two driving electrodes independently.

(3) The liquid droplet jetting head of (1), wherein one nozzle is disposed at a position corresponding to middle of two driving electrodes.

BRIEF DESCRIPTION OF THE DRAWINGS

FIG. 3(*b*) is a perspective view of a cross section D-D in FIG. 2.

FIG. 4(*b*) is a view showing operation of the head to jet the ink droplet.

FIG. 4(*c*) is a view showing operation of the head to jet the ink droplet.

FIG. 5(*b*) is a drawing to describe time shearing operation of the head.

FIG. 5(*c*) is a drawing to describe time shearing operation of the head.

DETAILED DESCRIPTION OF THE PREFERRED EMBODIMENT

The following describes the present invention with reference to embodiments, without the present invention being restricted thereto:

The following is a description of the preferred embodiments of this invention using the drawings.

Liquid fills the flow path in the liquid jetting head related to the present invention can be any liquid. In the following description, an inkjet head (hereinafter may called head), which is a liquid jet head using ink as the liquid to fill the flow path, is used for descriptions.

Also, as a liquid jetting apparatus provided with such liquid jetting head, an inkjet recording apparatus is exemplified for the descriptions.

Meanwhile, in the descriptions of embodiments, for example, except for the case where each driving electrode 16*a-a*, 16B-a, 16A-b, 16B-b . . . is described, alphabet suffixes may be omitted to describe integrally. This will be also applied for other components of the head.

Inkjet Recording Apparatus

Figure 1:
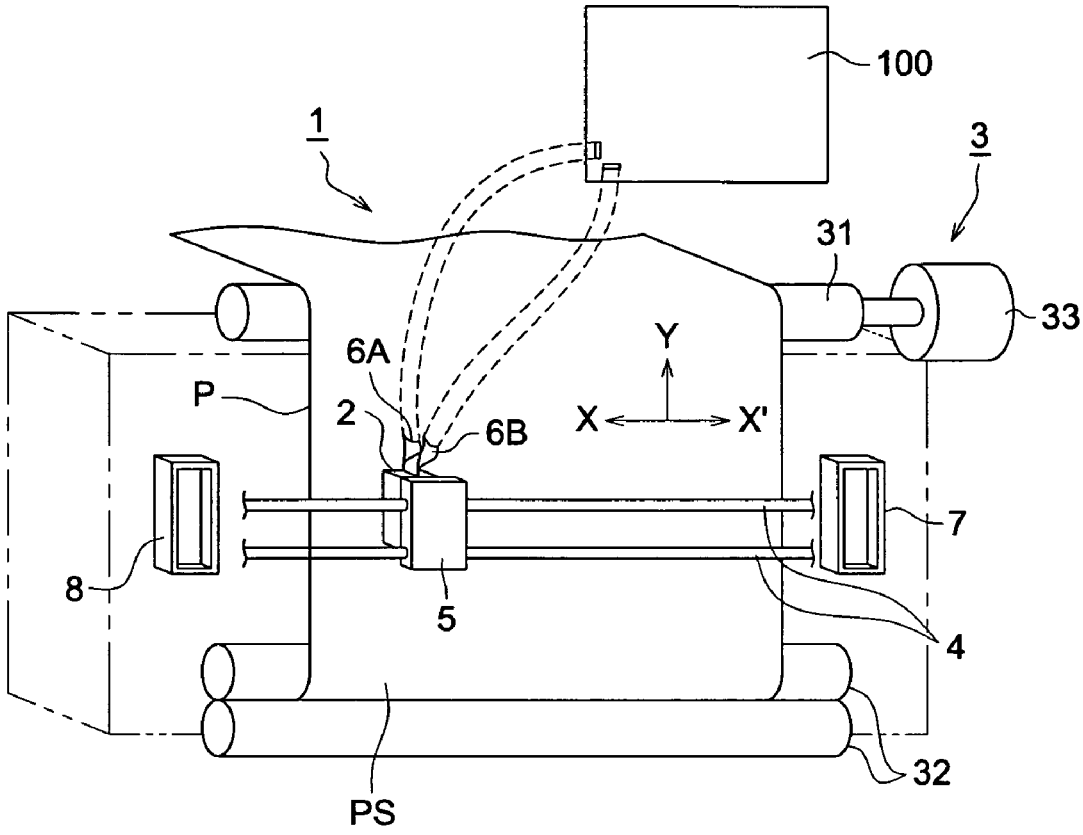
FIG. 1 is a view showing a schematic structure of an inkjet recording apparatus.

FIG. 1 is a view showing a schematic structure of inkjet recording apparatus to which the liquid jetting apparatus related to the liquid jet head of the present invention is applied. In inkjet recording apparatus 1, the base material of recording medium P is grasped by conveyance roller 32 of conveyance mechanism 3, then further conveyed to Y direction shown by the figure through conveyance roller 31 rotated by conveyance motor 33.

Between conveyance roller 31 and conveyance roller 32, inkjet head 2 is arranged to oppose to recording surface PS of recording medium P. This head 2 is provided on carriage 5 so that a nozzle surface side faces recording surface PS of recording medium P. Carriage 5 is arranged to be reciprocated by an unillustrated driving device in a X-X' direction (main scanning direction) shown by the figure which is almost perpendicular to conveyance direction (sub-scanning direction) of aforesaid recording medium P along guide rail 4 which is spanned in a width direction of recording medium P. Control circuits 24A and 24B (see FIG. 3) are electrically connected to control circuit board 100 on a main body side through FPC 6A and FCP 6B.

Meanwhile, as the base material, any material such as paper, resin, glass and metal can be used.

Head 2 is connected with ink tank 9 (see FIG. 3) through ink supplying tube 27 and ink is supplied from ink tank 9 to head 2.

Head 2 moves above recording surface PS of recording medium P in X-X' direction shown by the figure according to movement of carriage 5 and records a desired inkjet image by jetting the ink droplet in this moving process.

Meanwhile, numeral 7 in the figure presents an ink receiving vessel which is disposed outside a recording area in a stand-by position such as a home position of head 2. While head 2 is in this stand-by position, a small amount of ink drop let is discarded into ink receiving vessel 7. While head 2 is in the stand-by position for a long period of time, a nozzle surface of head 2 can be capped to protect the surface thereof by an unillustrated cap. Also, numeral 8 represents an ink receiving vessel disposed on an opposite position of the aforesaid ink receiving vessel 7, interposing recording medium P between them. In case printing is performed in both forward and backward directions, ink receiving vessel 8 receives the ink droplet discarded in the same manner as above when a forward stroke is switched to a backward stroke.

Structure of Head

The liquid droplet jetting head is characterized by having a plurality of dividing walls to divide a plurality of flow channels, wherein at least a portion of the dividing wall is formed with a piezoelectric element; flow paths having rectangular tubular form formed by an upper wall to close an upper surface of the flow path and a lower wall to close a lower surface of the flow path, along an array direction of the plurality of the flow paths; nozzles to jet liquid in the flow paths as a liquid droplet; and two driving electrodes independently formed on each wall surface of the dividing wall in a longitudinal direction of the flow path having the rectangular tubular form; wherein the nozzle is formed on either the upper wall or the lower wall.

Here, the flow paths to function as the ink flow paths to which ink is supplied and the flow paths to function as air flow paths to which the ink is not supplied may be arranged alternately. Also, all the flow paths may function as the ink flow paths without having the air flow paths.

Meanwhile, in this specification, a surface from which ink is jetted is called "upper surface" and the other side of the surface is called "lower surface". Also, in head 2, both ends of ink flow path are called "front surface (an outer side surface located on the right side of FIG. 3)" and "rear surface (an outer side surface located on the left side of FIG. 3)" respectively.

Figure 2:
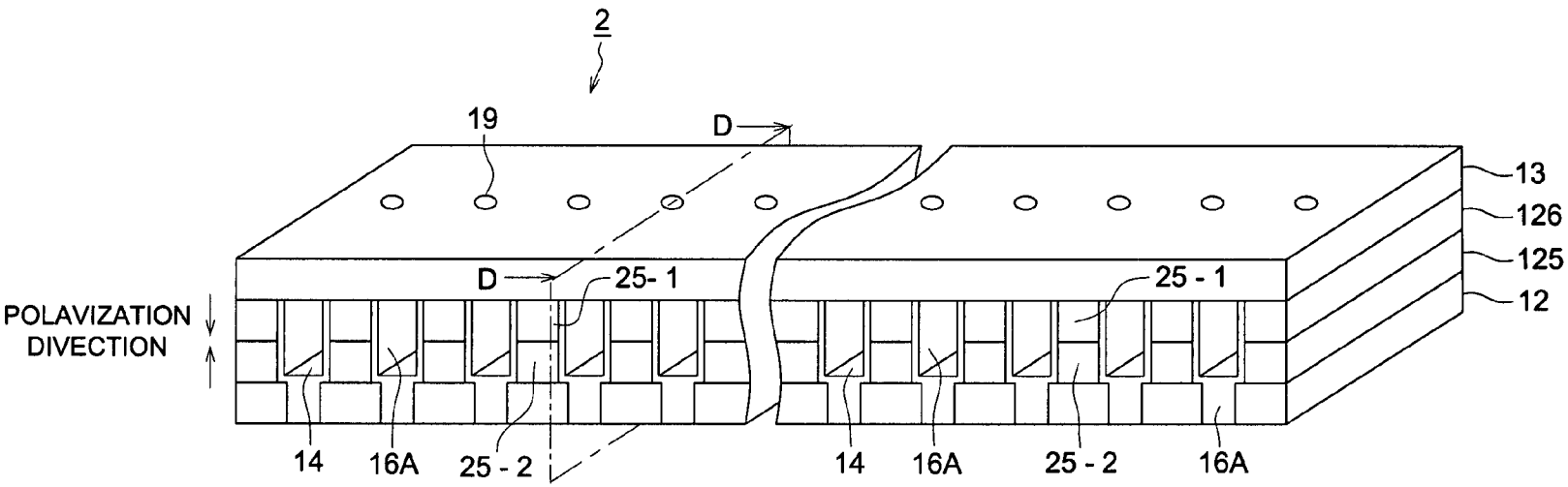
FIG. 2 is an exploded perspective view of a shear mode type inkjet head representing an embodiment of the liquid jetting head.
Figure 3:
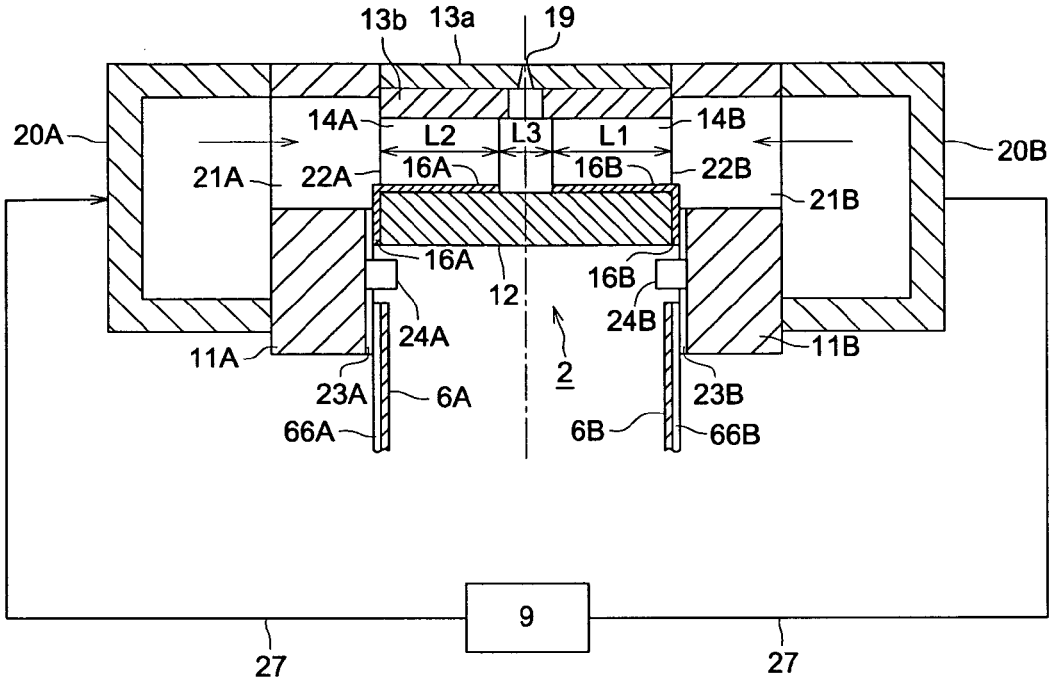
FIG. 3(*a*) is a cross-sectional view of the head in FIG. 2 in which a wiring substrate and a manifold are provided.
Figure 3:
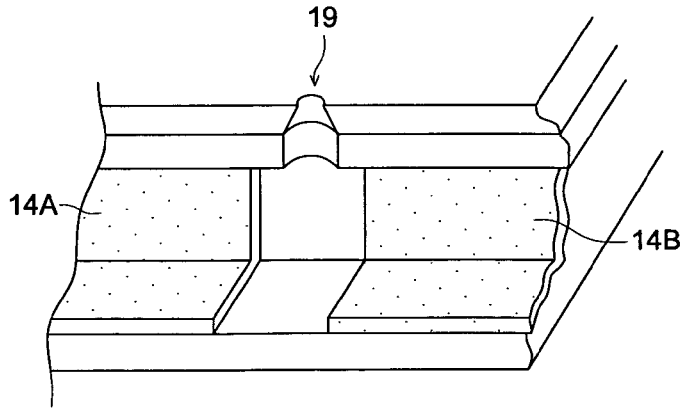

FIG. 2 is an exploded perspective view showing an example of head 2 in which all the paths function as the ink path without having the air flow path. FIG. 3(*a*) is a vertical cross-sectional view along D-D line of a head to which wiring substrate 11 in which through holes 21 common for a plurality of the ink flow paths are formed respectively on the front and rear surfaces of head 2 of FIG. 2, and manifold 20 are attached. Meanwhile, the wiring substrate and the manifold are omitted in FIG. 2.

In the figure, numeral 2 represents a head, numeral 12 represents a lower wall jointed on a lower surface of head 2, numeral 13 is an upper wall having a nozzle jointed on an upper surface of head 2, numeral 11 is the wiring substrate (FIG. 3) and numeral 6A and 6B are FPC jointed to wiring substrate 11.

Head 2 of the present example has dividing walls 25-1 and 25-2 formed by a piezoelectric element dividing a plurality of ink flow paths 14, ink flow paths 14 having rectangular tubular form formed by an upper wall 13 to close an upper surface of the flow path 14 and a lower wall 12 to close a lower surface of the flow path, in an array direction of a plurality of the ink flow paths 14, nozzles 19 arranged singly corresponding to each ink flow path to jet the ink in ink flow path 14 as the ink droplet, and two driving electrodes 16A and 16B formed on wall surfaces of the dividing walls 25-1 and 25-2 separately in a longitudinal direction of flow path 14 having the rectangular tubular form; wherein nozzle 19 is formed on the upper wall 13.

In head 2, ink flow paths 14 and driving walls 25-1 and 25-2 formed of the piezoelectric element are arranged alternately between upper wall 13 and lower wall 14. A shape of ink flow path 14 is that both dividing walls rise almost vertically in respect to upper wall 13 and lower wall 12 and are parallel each other. As FIG. 3 shows, an end 22A and the other end 22B of each ink flow path 14 are arranged on a front surface and rear surface of head 2 and each ink flow path 14 is a straight type which size and shape are almost uniform in a longitudinal direction from end 22*a* to another end 22B. As above, since ink flow path 14 is straight type, there is realized an inkjet head having superior ability in babble purge, high electric efficiency, low heat generation and superior ability in high speed response.

To manufacture such head 2, first, two pieces of piezoelectric element substrates are jointed on lower wall 12 representing a substrate with an epoxy type adhesive. As the piezoelectric material, publicly know piezoelectric materials, which are distorted by applying electric voltage, can be used. Lead zirconate titanate (PZT) is particularly preferred. Two pieces of the piezoelectric substrates 125 and 126 are laminated each other so that polarized directions (shown by arrow) oppose each other and jointed onto lower wall 12 with the adhesive.

Next, piezoelectric substrate 125 and 126 are grinded with a dicing blade to form a plurality of parallel grooves. Thereby, dividing walls 25-1 and 25-2 formed by piezoelectric element having opposite polarity directions in a height direction are created in parallel on lower wall 12. Each grooves become straight ink flow paths 14 having the same shape and size in the longitudinal direction by grinding piezoelectric element substrates 125 and 126 from an end to the other end in almost the same depth. Because two pieces of piezoelectric element substrates 125 and 126 have opposite polarity directions, whole dividing walls 25-1 and 25-2 make shearing distortion efficiently with a large distortion amount. Thus a high pressure can be applied to the ink in ink flow path 14 with a low driving voltage. Also, an image quality can be improved by suppressing deviations of ink landing.

Also, instead of using lower wall 12, by using thick piezoelectric substrate 125, and by grinding a plurality of parallel grooves from thin piezoelectric substrate 126 side to a middle of thick piezoelectric substrate 125 in a depth direction (height direction), dividing walls 25-1 and 25-2 having opposite polarity directions in height direction are formed. The above is not illustrated. At the same time, a part of lower wall 12 may be formed integrally with piezoelectric substrate 125.

Next, driving electrode 16 is formed on an inner surface of each ink flow path 14 formed in the above way. Metals to form driving electrode 16 are Ni, Co, Cu and Al. Al and Cu are preferably used from a view point of electric resistance. However, from the other view point of corrosion, strength and cost, Ni is preferably used. Also, a laminated structure where Au is laminated on Al may be used.

As a method of forming driving electrode 16, while there are quoted methods of forming a metal film using vacuum device such as vapor deposition method, spattering method plating method and CVD (chemical vapor disposition method), plating method is preferable, and in particular forming by non electrolytic plating is preferable. By non electrolytic plating, the metal film which is even and free from pin hole can be formed. A preferable range of plating thickness is from 0.5 to 5 μm.

Also, since driving electrodes 16 have to be independent for each ink flow path 14, it is preferred that the metal film is not formed on the upper surface of dividing wall 25-1 and on the front and rear surfaces of the head except for an extended portion to be described. Further, since driving electrodes 16 have to be formed independently as two driving electrodes 16A (length L2) and 16B (length L1) which are disposed in a longitudinal direction of ink flow path 14 formed in a rectangular tubular form independently on the wall surfaces of dividing walls 25-1 and 25-2, it is necessary that the metal film is not formed in about a center portion (length L3) in a longitudinal direction of ink follow path 14. Therefore, it is preferred that driving electrodes 16A and 16B, which are separated at a center of the ink flow path, are selectively formed on a bottom surface of each ink flow path 14, on a side surface of each of dividing walls 25-1 and 25-2, and the extended portion by adhering dry film or by forming a resist in advance, for example, on an upper surface of each dividing wall 25-1, the front and rear surfaces of the head except for the extended portion and a center portion in a longitudinal direction of an ink flow path, and by removing them after forming the metal film. Meanwhile, it is possible to form the metal film on all the surfaces and remove it from unnecessary portions by laser beam or etching.

In the present embodiment, L1=L2 however, L1 and L2 can be different each other.

Hereinafter, the ink flow path and the dividing wall corresponding to driving electrode 16A are described as ink flow path 14A and dividing wall 25A, and the ink flow path and the dividing wall corresponding to driving electrode 16B are described as ink flow path 14B and dividing wall 25B.

After forming driving electrodes 16A and 16B in the above way, a piece of substrate representing upper wall 13 is jointed on the upper surface of dividing wall 25-1 by using an epoxy based adhesive. On upper wall 13, nozzle 19 is opened at a position corresponding to each ink flow path 14.

As a material of lower wall 12 and upper wall 13, non piezoelectric and non metal material is preferred because it has to be formed by a material having a high rigidity, since lower wall 12 and upper wall 13 are to be jointed with an apex surface of the dividing wall and need to restrain the apex surface of the dividing wall. As a substrate composed of the non piezoelectric and non metal material, at least one of the followings are preferred to be selected which are alumina, aluminum nitride, zirconia, silicon, silicon nitride, silicon carbide, quartz and non polarized PZT. Also, a material used for lower wall 12 and upper wall 13 is preferred that its thermal expansion coefficient is similar to a thermal expansion coefficient of PZT representing the piezoelectric material which is usually used for the dividing wall, and is particularly preferred to be aluminum nitride or non polarized PZT. The reason is that when lower wall 12 and upper wall 13 are bonded with non polarized PZT, a thermoset adhesive is used, and if the thermal expansion coefficient is far from that of the piezoelectric material, there are problems that a distortion and an amotion between the materials occurs when it is cooled. Also, the distortion and the amotion between the lower wall and the upper wall similar to the above caused by heat of driving the piezoelectric material occur can be suppressed. Meanwhile, as the aluminum nitride shown in the example, AlN-BN (BN is nitride boron) of Sumikin Ceramics and Quartz Co., Ltd. can be used.

Also, in the head of the present invention, the nozzle is formed on either the upper wall or on the lower wall. Since it is difficult to form the nozzle in a proper shape on aforesaid alumina, aluminum nitride, zirconia, silicon, silicon nitride, silicon carbide, quartz and non polarized PZT, it is preferred that lower wall 13 is configured as a composite member where lower wall 13*a* on which the nozzle is formed and supporting member 13*b* are laminated.

As a material of nozzle plate 13*a*, a resin such as polyimide resin or steel such as stainless steel can be used. As methods to form the nozzle, laser machining for the resin and press work for the metal are applicable. In either methods, the nozzle having the proper shape can be formed. From the point of productivity, laser machining is preferred, and in particular machining by excimer laser is preferred. As for a nozzle forming direction, the nozzle can be formed either from the supporting member side or from the nozzle plate side. However, a taper shaped where a nozzle shape is getting small towards nozzle outlet side (ink ejection side of the head), is preferred so as to obtain excellent jetting characteristic, thus by forming hole from a bonding surface, a taper shape where a nozzle shape is getting small towards nozzle outlet side can be realized. In the present invention, it is preferred that laser machining is carried out on the composite member from the supporting member side to form the hole and the supporting member side is bonded with a piezoelectric member from the view point of productivity and accuracy of machining as well as to be able to obtain various shapes.

As supporting member 13*b*, aluminum nitride or non polarized PZT is preferred to be used. On supporting member 13*b*, there is provided a cylindrical through hole, which has a diameter greater than an entering diameter of the nozzle, as an ink inlet port corresponding to each nozzle hole. By configuring supporting member 13*b* with a material having a high rigidity, the aforesaid effects can be obtained.

For example, first, a nozzle plate 13*a* configured by the polyimide resin on which the nozzle hole is not yet formed is pre-heated and bonded on supporting member 13*b* having the through hole corresponding to the nozzle hole configured by the aluminum nitride or non polarized PZT so as to make a composite member, thereafter, excimer laser is radiated to the nozzle plate from supporting member side in a normal temperature to form the nozzle hole, then the composite substrate where the nozzle hole is formed is bonded on the piezoelectric member by heating adhesion, thereby because the thermal expansion coefficients of the composite member and PZT are similar, the aforesaid effects are obtained and there is realized bonding in which misalignment of nozzle position in respect to the ink flow channel of the piezoelectric member is reduced. Also, bonding in a direction where the taper-shaped nozzle is directed so as to be large at ink flow channel side and getting smaller towards outside can be easy.

Head 2 formed in the above way is provided with one nozzle 19 which is located at a position corresponding to the middle of two driving electrodes 16*a* and 16B disposed in a longitudinal direction of the aforesaid ink flow path 14 having a rectangular tubular form on upper wall 13. With this configuration, two driving electrodes 16A and 16B can be provided close to nozzle 19 and a pressure wave from ink flow paths 14A and 14B formed by driving electrodes 16A and 16B can be propagated in a condition where energy loss is reduced, thus it is an preferable embodiment.

In this way, on a front surface of head 2, there is formed driving electrode 16A which is extended from a portion of driving electrode 16A (a surface of lower wall 12 facing inside ink flow path 14) formed on a bottom of ink flow path 14 to a front edge surface of lower wall 12.

In the same manner, on a rear surface of head 2, there is formed driving electrode 16A which is extended from a portion of driving electrode 16B (a surface of lower wall 12 facing inside ink flow path 14) formed on a bottom of ink flow path 14 to a rear edge surface of lower wall 12.

Further, on the front surface of head 2, wiring substrate 11A and manifold 20A are jointed and on the rear surface of the head 2 wiring substrate 11B and manifold 20B are jointed, then each manifold and ink tank 9 are connected with ink supplying tube 27.

Wiring substrate 11 has the same width as a width of head 2 (lateral direction in FIG. 2), extending in a direction perpendicular to a array direction of ink flow path 14 of head 2 (downward in FIG. 2) and has a projecting portion which largely projects from a bottom surface of head 2.

Also, on wiring substrate 11, there is formed through hole 21 extending along its width direction. Through hole 21 is machined in a size which is able to cover opening 22 of all ink flow paths 14 along an array direction of the ink flow path of head 2 to form a common ink chamber.

Also, each projecting portion of wiring substrates 11A and 11B function as jointing sections of FPC 6A and FPC 6B where wiring electrodes 23A and 23B are formed on a surface representing jointing surface side to be jointed with head 2, in the same pitch and the same number as driving electrode 16A and 16B formed on the front and rear surface of head 2.

Also, driving circuits 24A and 24B are mounted so as to drive dividing wall 25A and 25B formed by piezoelectric element on wiring substrates 11A and 11B, and driving circuit 24A and 24B are connected electrically with wiring electrode 23A and 23B respectively.

Wiring electrodes 23A and 23B are connected electrically with wires 66A and 66B of FPC 6A and FPC 6B which are electrically connected with a control board of a main body of the apparatus when FPC 6A and FPC 6B are connected. With the above configuration, driving circuit 24A applies a driving signal to driving electrode 16A to drive dividing wall 25A and driving circuit 24B applies a driving signal to driving electrode 16B to drive dividing wall 25B respectively, based on a control signal from the control board. Thereby, driving of dividing wall 25A representing first pressure generation device and driving of dividing wall 25B representing second pressure generation device are configured to be controlled independently. As described later, by changing a shape and a timing of a driving pulse included in the driving signal to be applied to driving wall 25A and a driving pulse included in the driving signal to be applied to driving wall 25B, the amount of the ink droplet to be jetted is changed.

Head Driving Method when Ink is Jetted

First, there is explained a case where driving circuit 24A applies the driving signal to driving electrode 16A to drive dividing wall 25A based on the control signal from the control board, and to deform driving wall 25A representing the first pressure generation device for jetting the ink droplet from nozzle 19.

Figure 4:
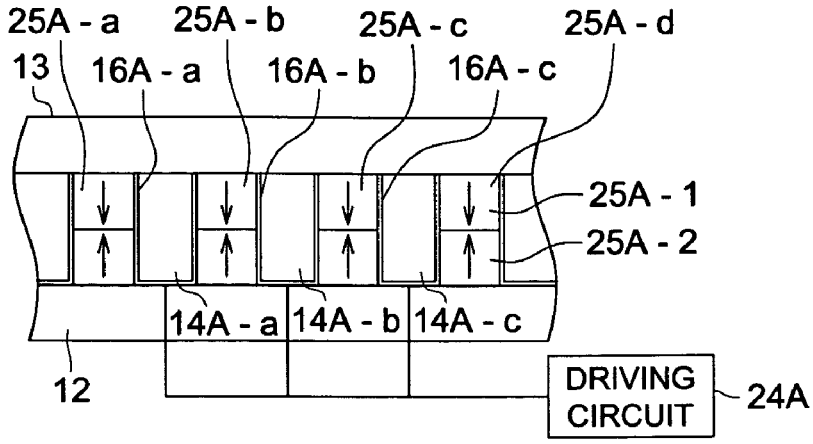
FIG. 4(*a*) is a view showing operation of the head to jet the ink droplet.
Figure 4:
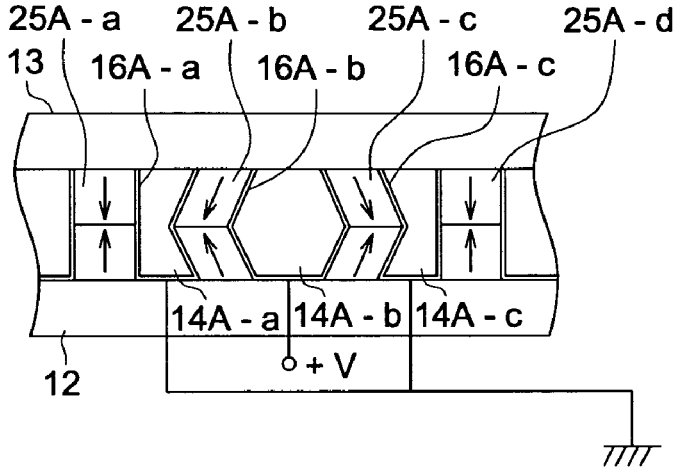
Figure 4:
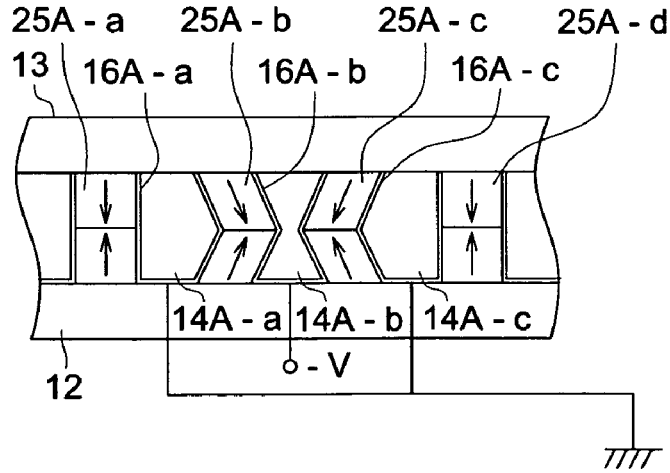

FIG. 4 is a drawing showing operation of ink jetting where the nozzle is not described.

As FIG. 4 shows, head 2 is a shear mode type head in which a number of ink flow paths 14 divided by a plurality of dividing walls 25A-a, 25A-b, 25A-c formed by a piezoelectric material such as PZT are disposed between upper wall 13 and lower wall 12. In FIG. 4, there are shown three paths 14A-a, 14A-b and 14A-c which are part of a number of the ink flow paths 14. On a surface of dividing wall in each ink flow path 14, driving electrodes 16A-a, 16A-b and 16A-c are formed adhesively, and each driving electrode 16A-a, 16A-b and 16A-c is connected with driving circuit 24A.

Here, as shown by the arrow in FIG. 4, each dividing wall 25 is formed by two piezoelectric material 25A-1 and 25A-2 which are polarized in opposite directions, and for instance, piezoelectric material may be only at a part of symbol 25A-1 and has only to be at least a part of dividing wall 25.

When a jetting signal is applied by control of driving circuit 24A to driving electrodes 16A-a, 16A-b and 16A-c which are laminated on a surface of each dividing wall 25, the ink droplet is jetted from nozzle 19 through an operation exemplified below. Meanwhile, all of driving electrodes 16B are grounded.

First, while the jetting signal is not applied to none of driving electrodes 16A-a, 16A-b and 16A-c, none of dividing walls 25*a*-*a*, 25A-b and 25A-c is distorted. Then in a status show by FIG. 4 (*a*), when driving electrodes 16A-a and 16A-c are grounded, and the jetting signal is applied to driving electrode 16A-b, an electric field is created in a direction perpendicular to the polarized direction of the piezoelectric material forming dividing walls 25*a*-*b* and 25A-c so as to cause a horizontal shift to a jointing surface of dividing walls 25*a*-1 and 25A-2. Thus dividing walls 25A-b and 25A-c are distorted outward each other as FIG. 4(*b*) shows, and an capacity of ink flow path 14A-b is increased and then negative pressure is created inside ink flow path 14A-b so that ink flows into the in flow path.

Thereafter, when a voltage becomes 0 from the above status, dividing walls 25A-b and 25A-c return to a neutral position shown by FIG. 4(*a*) from an inflated position shown by FIG. 4(*b*) and a high pressure is applied to the ink in ink flow path 14A-b. After that, the jetting signal is applied so as to distort dividing walls 25A-b and 25A-c in an opposite direction each other respectively as FIG. 4(*c*) shows. Thus the capacity of ink flow path 14A-b is decrease and positive pressure is created in ink flow path 14*a-b*. Thereby an ink meniscus formed by some of the ink filling flow path 14A-b moves to a direction to be pushed out from the nozzle. When the positive pressure reaches to a level where the ink droplet is jetted from the nozzle, the ink droplet is jetted from the nozzle. Hence, other ink flow paths 14A operate in the same manner as above by applying the jetting signal.

As above, in case head 2 having a plurality of ink flow path 14 separated by dividing walls 25 wherein the piezoelectric material forms at least a part of the dividing wall is driven, an operation of an ink flow path effects adjacent ink flow paths. Thus usually ink flow paths 14 are divided into more than two separate groups consist of non adjacent flow paths 14 which impose more than one ink flow path 14 between them in a plurality ink flow paths 14, then ink jetting operation is conducted subsequently on time sharing basis for each groups. For example, in case a solid image is outputted by operating all ink flow paths 14, the ink flow paths are divided into three groups by selecting the non adjacent ink flow paths so as to impose two ink flow paths between them, then ink jetting is conducted in three phases which is so called three cycle jetting method.

Figure 5:
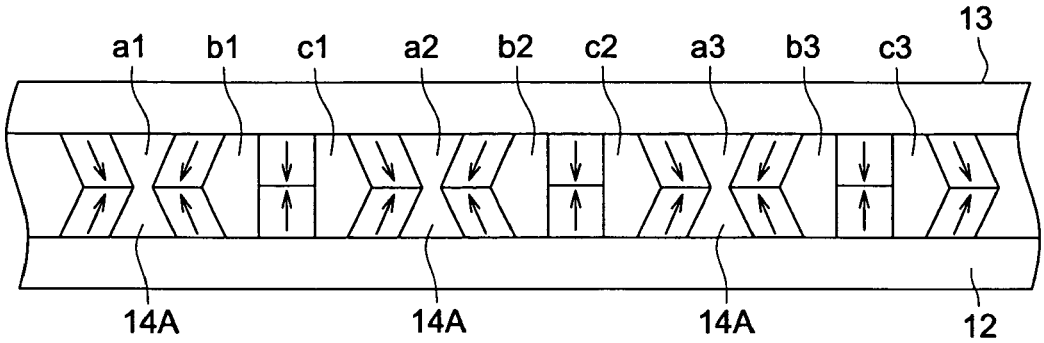
FIG. 5(*a*) is a drawing to describe time shearing operation of the head.
Figure 5:
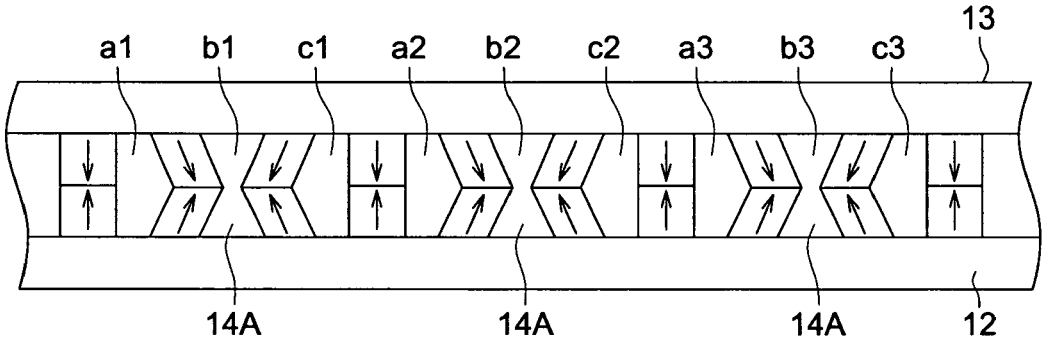
Figure 5:
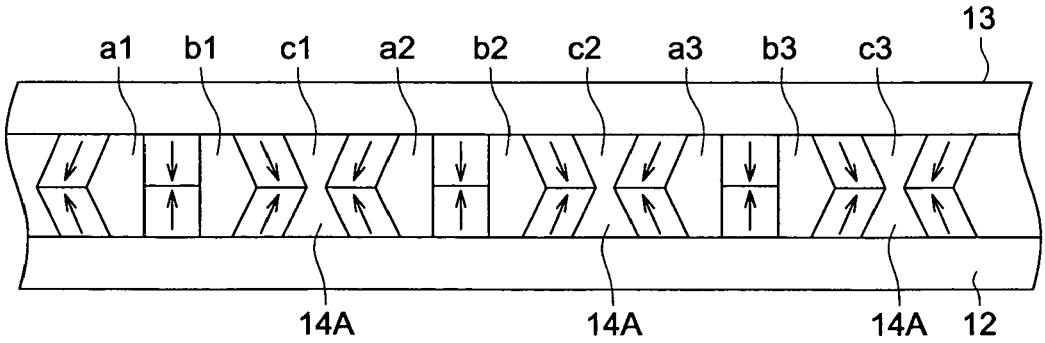
Figure 6:
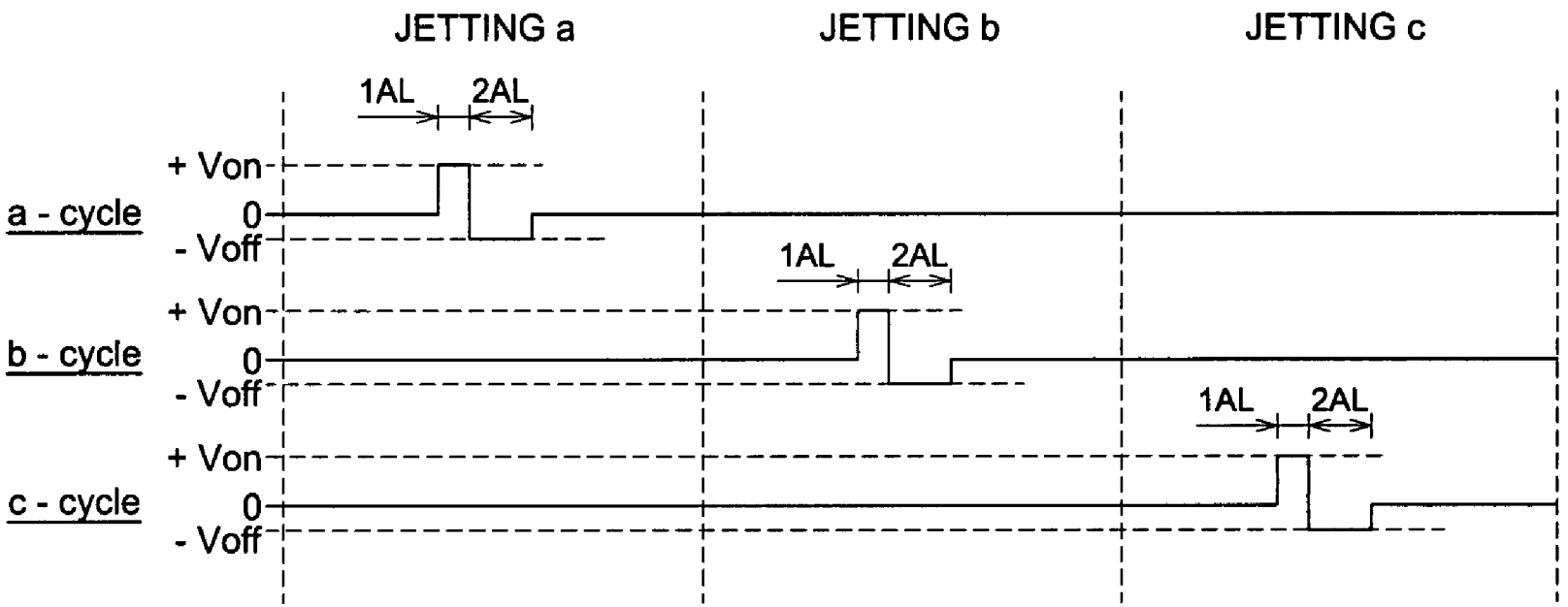
FIG. 6 is a timing chart of driving signals applied to ink flow paths in each of groups a, b and c.

The above three cycle jetting operation is further explained using FIG. 5. In an example in FIG. 5, for explanation, a head is supposed to be configured by nine ink flow paths 14A which are a1, b1, c1, a2, b2, c2, a3, b3 and c3. Also, a timing chart of driving signal applied to ink flow paths 14A of each group a, b and c for the head is shown in FIG. 6. In FIG. 6, vertical axis is time AL and horizontal axis is driving voltage.

For ink jetting, firstly, a voltage is applied to the driving electrode of each ink flow path of group a (a1, a2, and a3) and the driving electrodes of ink flow paths at both adjacent sides are grounded. For example, when an inflation pulse of a rectangular wave having 1 AL width and positive voltage (Von) is applied to the ink flow paths of group a, at a rising edge of the first inflation pulse, the dividing wall of the ink flow path in group a distorts outward and negative pressure is generated in the ink flow path 14A. With this negative pressure, the ink flows into ink flow path 14 from ink tank 9. This pressure wave is propagated in two directions i.e. a direction to common ink chamber 21A and a direction to ink flow path 14B. After 0.5 AL has elapsed, the pressure wave proceeds to common ink chamber 21A is inverted at border line 22A of common ink chamber 21A and returns to ink flow pass 14A. At this stage, the ink flows into ink flow path 14A from common ink chamber 21A. Also, the pressure wave proceeding to ink flow path 14B reaches ink flow path 14B and creates negative pressure in ink flow path 14B.

Meanwhile, AL (Acoustic Length) is ½ of acoustic resonance cycle of ink flow path 14. AL of an actual head is obtained as a pulse width when the flying speed of the ink droplet is a maximum, wherein a flying speed of the ink droplet jetted is measured by applying the rectangular wave pulse to dividing wall 25 formed by the piezoelectric material to jet ink and the pulse width is varied while a voltage of the rectangular wave is unchanged so that the flying speed of the ink droplet becomes a maximum.

Also, the pulse in the example is a rectangular wave having a constant crest voltage value, and supposing that O V is 0% and a maximum crest voltage is 100%, the pulse width is defined as a time from a point where the voltage rises or falls and becomes 10% from 0 volt on a leading edge of the pulse, to a point where the voltage falls or rises and becomes 10% from the crest value on a trailing edge of the pulse. Further, the rectangular wave means a wave shape having both a rising time and a falling time from 10% to 90% of crest value to be within ½ of AL and preferably within ¼ of AL.

If this status is maintained for a period of 1 AL, the pressure is inversed to a positive pressure, then by grounding the electrode in this moment, the distorted dividing wall regains an original posture and a high pressure is applied to the ink in ink flow paths 14A of group a. Further, in the same timing, by applying a deflation pulse which is a negative voltage (Voff) rectangular wave having a wave width of 2 AL, the dividing wall distorts inward at initial rising edge of the deflation pulse, then the high pressure is further applied to the ink so that the ink droplet is pushed out. After 1 AL elapses, the pressure is inversed and negative pressure is created in ink flow path 14A, then further, after 1 AL elapses, the pressure in ink flow path 14A is inversed to a positive pressure. In this moment, the electrodes are grounded and the distorted dividing walls regains the original posture, then a remaining pressure wave can be cancelled.

Subsequently, each ink flow path in group b (b1, b2 and b3) and further each ink flow path in group c (c1, c2 and c3) are operated in the same manner as the above.

Figure 7:
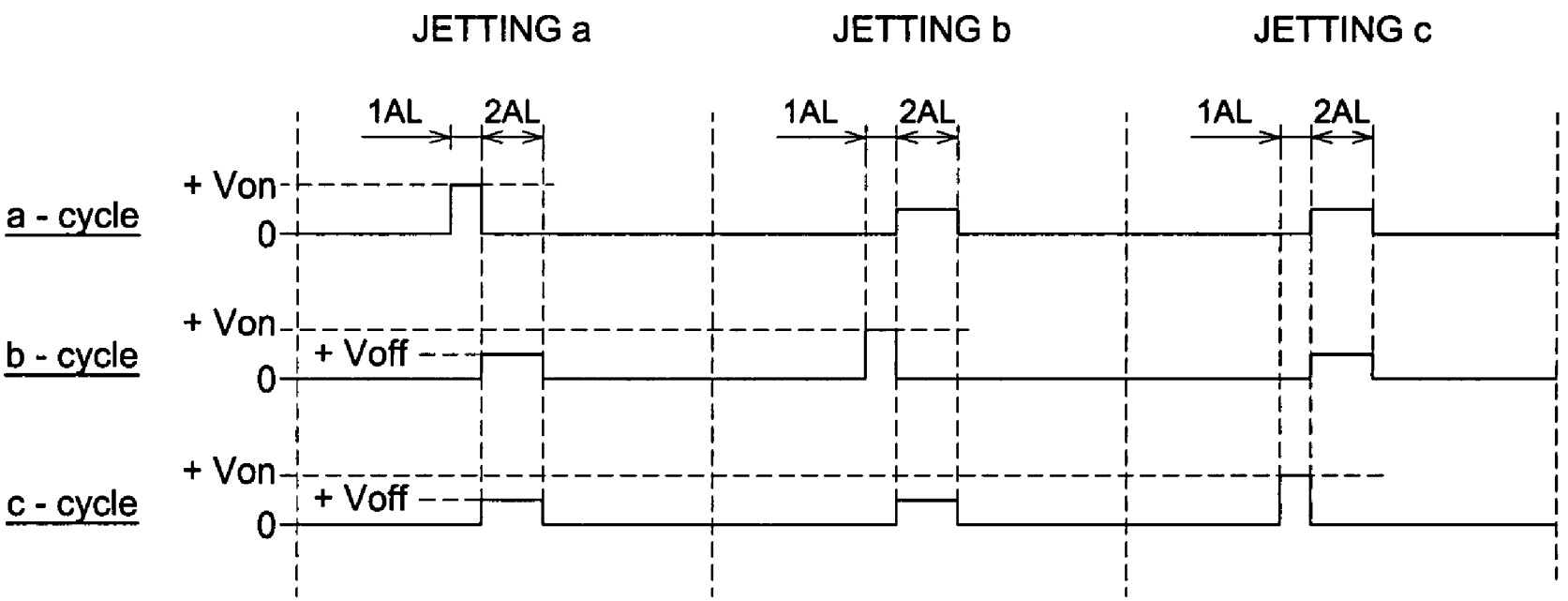
FIG. 7 is a timing chart of driving signals in case only positive voltage is used.

In an ink jet head of the above shearing mode type, since the distortion of the dividing wall is caused by a difference of voltage applied to the electrode disposed on the both side of the wall, the same operation can be realized as shown by FIG. 7 by applying the positive voltage to the electrodes in the ink flow paths on both adjacent sides and grounding the ink flow path so as to jet ink, instead of applying the negative voltage to the electrodes of ink flow path to jet ink. According to the latter method, since it can be operated only by the positive voltage, the latter method is preferable.

Pulse width D of the inflation pulse is preferred to be from 0.7 AL to 1.3 AL from a view point of an efficiency of jetting the ink droplet, and pulse width R is preferred to be from 1.7 AL to 2.3 AL from a view point of easiness of canceling the remaining pressure wave.

Also, if a relation of a driving voltage Von (V) of the inflation pulse and a driving voltage Voff (V) of the deflation pulse is $|Von| \geqq |Voff|$, it is effective to accelerate supplying ink into the ink flow path and in particular it is effective when high viscosity ink is driven by a high frequency.

Meanwhile, a standard voltage of voltage Von (V) and voltage Voff (V) is not limited to zero volt. Voltage Von and voltage Voff mean voltage differences from a certain voltage.

In FIG. 4 to FIG. 7, there has been explained cases where driving circuit 24A applies the driving signal to driving electrode 16A to drive dividing wall 25A and to cause distortion on dividing wall 25A representing the first pressure generation device so that ink droplet is jetted from nozzle 19. Also, a case where driving circuit 24B applies the driving signal to driving electrode 16B to drive dividing wall 25B and to cause distortion on dividing wall 25B representing the second pressure generation device so that ink droplet is jetted from nozzle 19 can be realized by the same principle.

Next, in case two driving electrodes are driven simultaneously, the amount of ink droplet can be modulated in multi steps by adjusting a timing of the driving pulse applied to each driving electrode. Also, compare to driving one side, there is obtained an effect that the driving voltage can be reduced.

Based on the control signal from the control board, driving circuit 24A applies the driving signal to driving electrode 16A so as to drive dividing wall 25A and cause distortion on dividing wall 25A representing the first pressure generation device, and driving circuit 24B applies the driving signal to driving electrode 16B to drive dividing wall 25B and cause distortion on dividing wall 25B representing the second pressure generation device so that ink droplet is jetted from nozzle 19.

Figure 8:
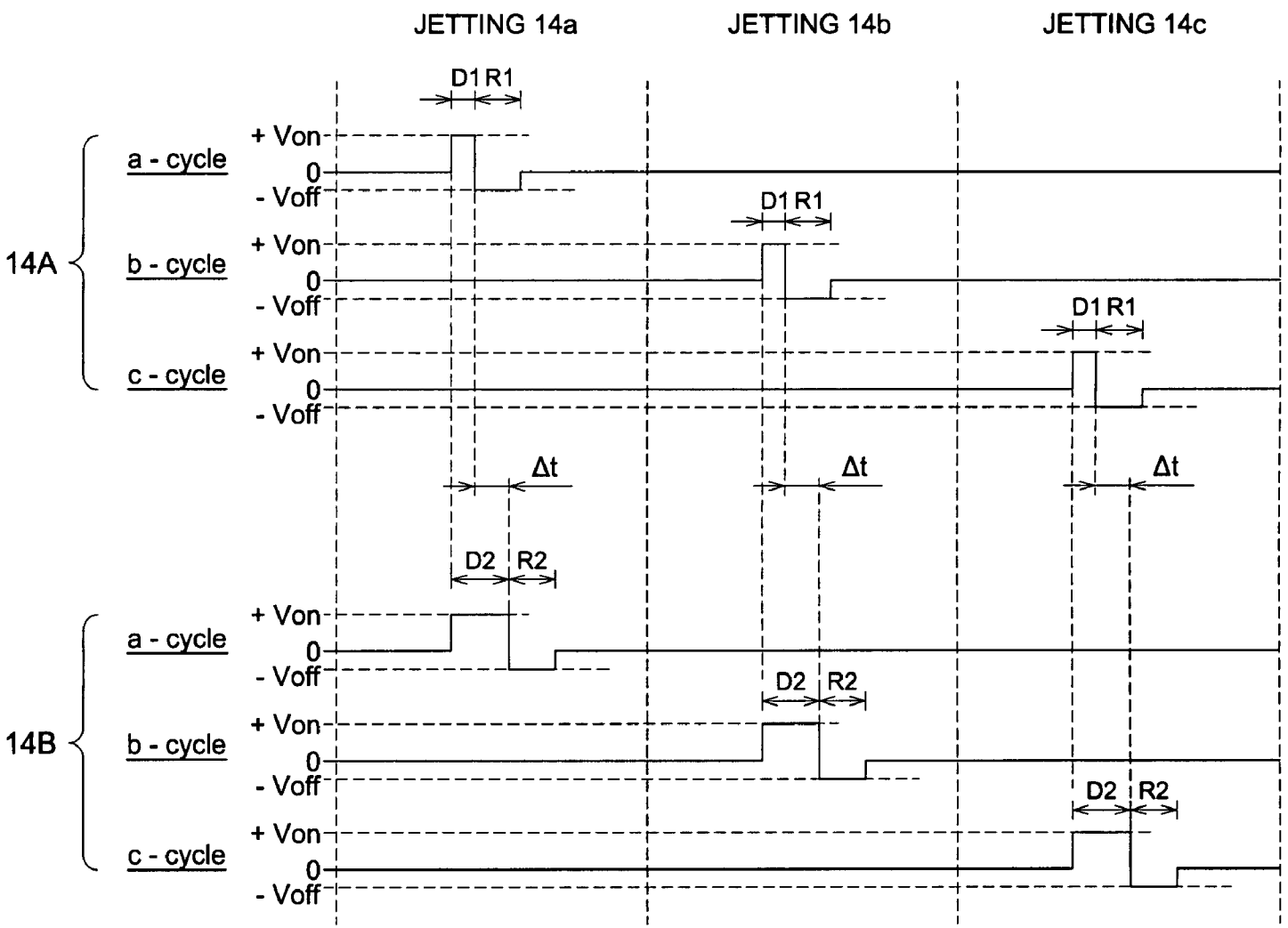
FIG. 8 is a timing chart of driving signals applied to ink flow paths in each of groups a, b and c.

FIG. 8 is a timing chart showing the driving signal. As the driving signals, the inflation pulse of the rectangular wave having pulse width D1 and the subsequent deflation pulse of the rectangular wave having pulse width R1 are applied to driving electrode 16A of ink flow path 14A, and the inflation pulse of the rectangular wave having pulse width D2 and the subsequent deflation pulse of the rectangular wave having pulse width R2 are applied to driving electrode 16B of ink flow path 14B.

The driving signals applied to two driving electrodes 16A and 16B are configured to have the same timing of rising edge of the inflation pulses, and a time difference Δt between timings of falling edges of the inflation pulses and the deflation pulses. By changing Δt, in case a phase of the pressure wave created by distortion of dividing wall 25A at the falling edges of inflation pulse and deflation pulse, and a phase of the pressure wave created by distortion of dividing wall 25B are the same, pressure waves created by distortion of each dividing wall are added, thus the ink is jetted by a greater pressure. In case the pressure waves created by dividing wall 25A and dividing wall 25B have different phases, the pressure waves created by distortion of each dividing wall subtract each other and a sustaining time of the pressure applied to the nozzle can be changed effectively, thus the size of the ink droplet jetted at one time can be varied in a plurality of steps.

Pulse width D1 of the inflation pulse is preferred to be from 0.7 AL to 1.3 AL from a view point of efficient ink jetting and time difference Δt is preferred to be $0 \leqq \Delta t \leqq 2$ AL, because if Δt is too long, attenuation of the pressure wave increases at a timing where the falling edge of the inflation pulse to be applied to driving electrode 16B and the falling edge of the deflation pulse to be applied to driving electrode 16B are applied.

Also, deflation pulse width R1 and R2 are assigned appropriately to cancel its fluctuation in accordance with the phase and an amplitude of the pressure fluctuation.

Figure 9:
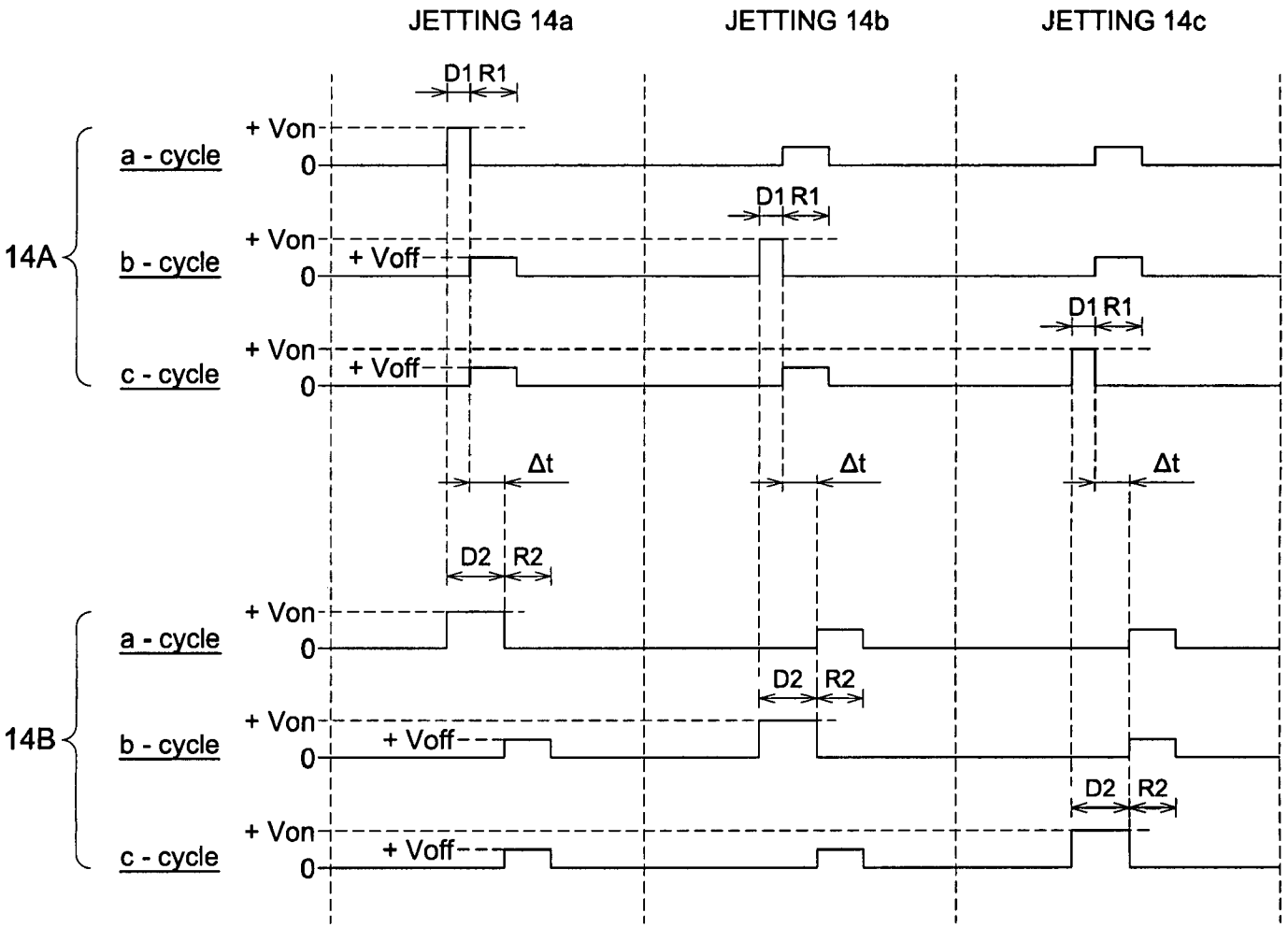
FIG. 9 is a timing chart of driving signals in case only positive voltage is used.

Also, in the aforesaid shearing mode type inkjet head, since the distortion of dividing wall is caused by the difference of the voltage applied to the electrodes disposed on both sides of the wall, the same operation can be realized by grounding the electrode of the ink flow path from which ink jets and by applying a positive voltage to the electrodes of both adjacent ink flow paths as shown by FIG. 9, instead of applying a negative voltage to the electrode of the ink flow path from which ink jets. According to the latter method, since it can be driven only by positive voltage, the latter method is preferable.

The above is a case of solid image (full driving) and in practice the driving pulse is changed in accordance with image data of each pixel.

Control circuit board 100 determines appropriate amount of the ink droplet to fill each pixel based on a resolution of image data and contrast data of each pixel. Then the ink flow path of the nozzle corresponding to each pixel is driven by the most suitable driving pulse to obtain a desired ink droplet with referring to internal ink droplet table. Thus the assigned driving pulse is applied from each driving circuit to each driving electrode 16 so as to jet the ink droplet having desired ink amount. A concrete example will be indicated in table 1 of an embodiment to be described. The amount of ink drop let can be varied by adjusting Δt.

Also, in case of changing the size of ink droplet, to make a landing position of ink steady, the flying speed of ink droplet has to be unchanged in any case, i.e. a case of jetting small ink droplet and a case of jetting large ink droplet. In an inkjet recording apparatus using the head of the present invention, as an example shows, by adjusting the driving voltage of the driving pulse, the flying speed is adjusted to a prescribed value.

To adjust the flying speed at the prescribed value, at least the voltage of either the inflation pulse or the deflation pulse has only to be adjusted. As mentioned above, since the rising edge of the deflation pulse has an effect to cancel a resonance of the pressure wave remaining in the ink flow path after jetting the droplet, the resonance of the pressure wave is adequately cancelled by maintaining a ration of driving voltage Voff of the deflation pulse to driving voltage Von of the inflation pulse, even if the voltages of the driving pulses are changed to make the flying speed steady.

Meanwhile, the driving pulse described above is one of examples, and the present invention is not limited to the driving pulse of this type. As the driving-pulses, a driving pulse consisting of a rectangular inflation pulse which inflates the capacity of the ink flow path and maintains it for a certain time thereafter bring the capacity back can be used. Also, besides the rectangular wave, a slope-shaped wave and an arbitrary analogue wave can be used.

Thus, because the head of the present invention is provided with two driving electrodes which are independently formed on the driving wall of one ink flow path, By utilizing interference of the pressure wave which is generated when the dividing wall is distorted by applying electricity to two driving electrodes, it is able to modulate the amount of ink droplet without causing side effects such as fluctuation of the flying speed.

Also, since dividing wall 25B representing the second pressure generating device can be formed in the same process and with the same member as dividing wall 25A representing the first pressure generating device, it can be formed easily by separating the driving electrode, thus the cost of manufacturing can be reduced.

In the above embodiment, there has been shown an example of the head where no air flow paths are provided and all the flow paths function as the ink flow paths. However, the head can be alternatively provided with the one functions as an ink flow paths to which ink is supplied and the one functions as an air flow paths to which ink is not supplied. Through holes 21 of wiring substrate 11 can be formed to correspond with openings 22 of every other flow paths 14. Namely, ink is supplied to every other flow paths and they becomes ink flow paths and then the flow paths between them become air flow paths to which ink is not supplied, thus an independent flow path head in which the ink flow paths and the air flow paths (dummy flow path) are alternatively formed is realized. By providing nozzle 19 corresponding the ink flow path, ink is jetted from nozzle 19. In this case, since shearing distortion of the dividing wall of the ink flow path does not affect the adjacent ink flow paths, driving of the dividing wall is easy.

Also, in the above embodiment, the driving pulse of the rectangular wave having a rising time and a falling time which are fast enough for AL is applied to the piezoelectric element. By using the rectangular wave, driving by utilizing acoustic resonance of the pressure wave more efficiently can be conducted. Compare to a method utilizing a trapezoid wave, the above embodiment has advantages that a jetting efficiency is superior, driving by lower driving voltage is possible and the driving circuit can be a simple digital circuit which is easy to design. Also, it has an advantage that assignment of the pulse width is easy. Further, it is possible to moderate the amount of ink droplet by utilizing interference of the pressure wave which is generated when the dividing wall is distorted by applying electricity to two driving electrodes without causing side effects such as fluctuation of the flying speed.

Also, the head of the present invention uses a shearing mode type piezoelectric element, which is distorted in shearing mode by applying an electric filed, for the dividing wall of the ink flow path as an pressure generating device.

Also, in the above description, as the liquid droplet jetting apparatus related to the present invention, applications for the inkjet recording apparatus have been exemplified, and as the liquid droplet jetting head, the inkjet head to record the image has been exemplified, though the present invention is not limited to the examples thereof. The present invention can be widely applied as a liquid droplet jetting head and a liquid droplet jetting apparatus having; a plurality of the dividing walls to divide a plurality of flow path, wherein at least a portion of the dividing wall is formed with the piezoelectric element, the flow path having rectangular tubular form formed by the upper wall to close the upper surface of the flow path along the array direction of the plurality of the flow paths and by the lower wall to close the lower surface of the flow path, the nozzle to jet the droplet of liquid in the flow path, two driving electrodes disposed in a longitudinal direction of the flow path having rectangular tubular form formed independently on each wall surface of the dividing wall, wherein the nozzle is formed on either the upper wall or the lower wall. It is effective particularly for industrial use which requires the amount of liquid shot for one dot to be modulated

Embodiment

Present Invention

On the shear mode type head (number of nozzles: 256) shown in FIG. 3, three cycle driving was conducted in the following conditions for only each of flow paths 14A, which are split into 3 groups, by using the driving signal (the voltage and the pulse width are shown in Table 1 (a)) show in FIG. 7.

Also three cycle driving was conducted in the following conditions for each of flow paths 14A and 14B which are split into 3 groups, by using the driving signal (the voltage and the pulse width are shown in Table 1) shown in FIG. 9.

Meanwhile, AL of the head was 7.4 μsec in case only 14 A was driven and 7.8 μsec in case both 14A and 14B are driven.

A water-soluble dye-based ink is use as the ink.

In this experiment, a polarized PZT is used as piezoelectric element substrate 125 and 126 and an aluminum nitride substrate (AIN-BN of Sumitomo ceramic co., ltd.) is used as lower wall 12. Also, as nozzle plate 13*a* forming upper wall 13, polyimide resin sheet having thickness of 75 μm where the nozzle holes are machined by excimer laser is used. The same aluminum nitride substrate as above having thickness of 100 μm is used as supporting member 13*b*.

In FIG. 3, a total length of ink flow path 14 is 6 mm, a portion having a width of 0.5 mm in a lateral direction where the driving electrode is not formed is provided in a middle section of ink flow path 14, length L3 is 1 mm, length L2 of driving electrode 16A is 2.5 mm and length L1 of driving electrode 16B is 2.5 mm. Also a center of the nozzle and a center of cylindrical opening section are positioned in a position corresponding to a center section of ink flow path 14.

Meanwhile, the head size is 310 μm in a height of ink flow path 14A and 14B, 82 μm in a width and 2.5 mm in a length. Nozzle 19 on nozzle plate 13*a* has a circle cross section, a diameter of the nozzle outlet of 27 μm and a taper angle of 6.3°. A diameter of cylindrical opening section of supporting member 13*b* is 60 μm.

On an arbitrary nozzle, the flying speed of the ink droplet was measured while varying the driving voltages (Von and Voff), (|Von|/|V off| is fixed at 1/1), In each driving signal, the driving voltage is fixed at a voltage where flying speed is 8 m/s, then the amount of the ink droplet is measured in this condition. Results are shown in table 1 (a).

Flying speed measurement: The speed of the ink droplet at a position where the ink droplet flies 1 mm from nozzle opening was measured.

COMPARATIVE EXAMPLE

The same driving was conducted except that L3 is 0, driving electrode 16 is provided throughout a total length of ink flow path 14, and three cycle driving was conducted for each of flow paths 14, which are split into 3 groups, by using the driving signal (the voltage and the pulse width are shown in table 1 (b)) show in FIG. 7. Meanwhile, AL of this head was 7.3 μsec.

On an arbitrary nozzle, the flying speed and the amount of the ink droplet were measured with varying the driving voltage (Von and Voff). Results are shown in table 1 (b).

TABLE 1 (a)

The present invention

| | | 14A | | | | 14B | | | | | Amount of liquid | Speed of liquid |
|---|---|---|---|---|---|---|---|---|---|---|---|---|
| Driving signal | AL (μsec) | Von (V) | Voff (V) | D1 (μsec) | R1 (μsec) | Von (V) | Voff (V) | D2 (μsec) | R2 (μsec) | Δt (μsec) | droplet (pl) | droplet (m/s) |
| A | 7.4 | 29 | 29 | 7.4 | 14.8 | 0 | 0 | 0 | 0 | — | 16.5 | 8 |
| B | 7.8 | 14.2 | 14.2 | 7.8 | 15.6 | 14.2 | 14.2 | 7.8 | 15.6 | 0 | 16.8 | 8 |
| C | 7.8 | 15.9 | 15.9 | 7.8 | 15.6 | 15.9 | 15.9 | 9.8 | 15.6 | 2 | 18.3 | 8 |
| D | 7.8 | 19.8 | 19.8 | 7.8 | 15.6 | 19.8 | 19.8 | 11.8 | 15.6 | 4 | 20.6 | 8 |
| E | 7.8 | 20.8 | 20.8 | 7.8 | 15.6 | 20.8 | 20.8 | 13.8 | 15.6 | 6 | 16.5 | 8 |
| F | 7.8 | 21.4 | 21.4 | 7.8 | 15.6 | 21.4 | 21.4 | 15.8 | 15.6 | 8 | 16.1 | 8 |

TABLE 1 (b)

An Example of reference

| | | 14 | | | | Amount of liquid | Speed of liquid |
|---|---|---|---|---|---|---|---|
| Driving signal | AL (μsec) | Von (V) | Voff (V) | D (μsec) | R (μsec) | droplet (pl) | droplet (m/s) |
| A | 7.3 | 10 | 10 | 7.3 | 14.6 | 13.6 | 4.58 |
| B | 7.3 | 11 | 11 | 7.3 | 14.6 | 15.4 | 6.19 |
| C | 7.3 | 12 | 12 | 7.3 | 14.6 | 17.1 | 7.54 |
| D | 7.3 | 13 | 13 | 7.3 | 14.6 | 18.7 | 9.01 |
| E | 7.3 | 14 | 14 | 7.3 | 14.6 | 20.5 | 10.38 |

As table 1 indicates, in the comparative example, there is a limit to vary the amount of ink droplet without changing the flying speed, and when the amount of ink droplet is increased by increasing the driving voltage, an increase of the flying speed is observed. In the present invention, the amount of the ink droplet can be varied without causing side effects such as fluctuation of the flying speed. Also, in a range where time difference Δt is from 0 to 1.5 AL, since the phase of the pressure wave caused by the distortion of dividing wall 25A and the phase of the pressure wave caused by the distortion of dividing wall 25B are the same, the pressure waves caused by distortion of each dividing wall are added each other and a larger ink droplet can be jetted from the nozzle by a greater pressure. Also, in a range where time difference Δt is from 0.5 to 1 AL, since the phase of the pressure wave caused by the distortion of dividing wall 25A and the phase of the pressure wave caused by the distortion of dividing wall 25B are different, the pressure waves caused by distortion of each dividing wall are subtracted, and a sustaining time of the pressure applied to the nozzle can be changed effectively so that the size of the ink droplet jetted from the nozzle can be varied in a plurality of steps.

According to the present invention, manufacturing is easy so that the cost of manufacturing can be reduced, and there can be provided the liquid droplet jetting head and the liquid droplet jetting apparatus, wherein the amount of ink droplet jetted from the nozzle can be varied in a plurality of steps without causing the side effects such as the fluctuation of the flying speed.

What is claimed is:

1. A liquid droplet jetting head, comprising:

dividing walls to form a plurality of flow paths in a shape of rectangular tubular having an upper wall to close an upper surface of the flow path and a lower wall to close a lower surface of the flow path wherein at least a portion of each dividing wall is formed with a piezoelectric element;

nozzles to jet liquid flowing in the flow paths as a liquid droplet; and two driving electrodes disposed separately on a wall surface of the dividing walls, wherein the two driving electrodes are disposed serially in a liquid flow direction of the flow path;

wherein the nozzles are formed on either the upper wall or the lower wall.

2. The liquid droplet jetting head of claim 1, wherein driving signals are applied to each of the two driving electrodes independently.

3. The liquid droplet jetting head of claim 2, wherein the diving signals to be applied to the two driving electrodes are rectangular waves having consistent inflation and deflation voltages and a time difference Δt between falling edges of the driving signals satisfies a formula below:

$$0 \leqq \Delta t \leqq 2AL.$$

4. The liquid droplet jetting head of claim 2, wherein an amount of the liquid droplet is varied by changing a voltage of the driving signal while maintaining a consistent flying speed of the liquid droplet.

5. The liquid droplet jetting head of claim 1, wherein one nozzle is disposed at a position corresponding to middle of the two driving electrodes.

6. The liquid droplet jetting head of claim 5, wherein the two driving electrodes are symmetrically disposed centering around a position corresponding to the nozzle.

7. A liquid droplet jetting apparatus, comprising:

a liquid droplet jetting head, comprising:

dividing walls to form a plurality of flow paths in a shape of rectangular tubular having an upper wall to close an upper surface of the flow path and a lower wall to close a lower surface of the flow path wherein at least a portion of each dividing wall is formed with a piezoelectric element;

nozzles to jet liquid flowing in the flow paths as a liquid droplet; and two driving electrodes disposed separately on a wall surface of the dividing walls, wherein the two driving electrodes are disposed serially in a liquid flow direction of the flow path;

wherein the nozzles are formed on either the upper wall or the lower wall.

8. The liquid droplet jetting apparatus of claim 7, wherein driving signals are applied to each of the two driving electrodes independently.

9. The liquid droplet jetting apparatus of claim 8, wherein the diving signals to be applied to the two driving electrodes are rectangular waves having consistent inflation and deflation voltages and a time difference Δt between falling edges of the driving signals satisfies a formula below:

$$0 \leqq \Delta t \leqq 2\ AL.$$

10. The liquid droplet jetting apparatus of claim 8, wherein an amount of the liquid droplet is varied by changing a voltage of the driving signal while maintaining a consistent flying speed of the liquid droplet.

11. The liquid droplet jetting apparatus of claim 7, wherein one nozzle is disposed at a position corresponding to middle of two driving electrodes.

12. The liquid droplet jetting apparatus of claim 11, wherein the two driving electrodes are symmetrically disposed centering around a position corresponding to the nozzle.

* * * * *